US005863304A

United States Patent [19]

Viall et al.

[11] Patent Number: 5,863,304

[45] **Date of Patent: *Jan. 26, 1999**

[54] STABILIZED THERMALLY BENEFICIATED LOW RANK COAL AND METHOD OF MANUFACTURE

[75] Inventors: Arthur J. Viall; Jeff M. Richards, both of Colstrip, Mont.

[73] Assignee: Western Syncoal Company, Billings, Mont.

[ * ] Notice: This patent issued on a continued prosecution application filed under 37 CFR 1.53(d), and is subject to the twenty year patent term provisions of 35 U.S.C. 154(a)(2).

[21] Appl. No.: 515,232

[22] Filed: Aug. 15, 1995

[51] Int. Cl.[6] ..... C10L 5/00

[52] U.S. Cl. ..... 44/626; 44/620

[58] Field of Search ..... 44/620, 626

[56] References Cited

U.S. PATENT DOCUMENTS

| | | | |
|---|---|---|---|
| 2,966,400 | 12/1960 | Lykken | 44/1 |
| 3,723,079 | 3/1973 | Seitzer | 44/1 R |
| 3,754,876 | 8/1973 | Pennington et al. | 44/1 B |
| 3,817,874 | 6/1974 | Wennerberg et al. | 252/445 |
| 3,980,447 | 9/1976 | Franke et al. | 44/10 D |
| 3,985,517 | 10/1976 | Johnson | 44/1 R |
| 4,053,285 | 10/1977 | Robinson et al. | 44/1 F |
| 4,170,456 | 10/1979 | Smith | 44/1 F |
| 4,210,423 | 7/1980 | Yan | 44/1 C |
| 4,249,909 | 2/1981 | Comolli | 44/1 G |
| 4,396,394 | 8/1983 | Li et al. | 44/1 G |
| 4,396,395 | 8/1983 | Skinner et al. | 44/6 |
| 4,400,176 | 8/1983 | Kutta | 44/1 R |
| 4,401,436 | 8/1983 | Bonnecaze | 44/1 G |
| 4,402,706 | 9/1983 | Wunderlich | 44/1 G |
| 4,402,707 | 9/1983 | Wunderlich | 44/6 |
| 4,403,996 | 9/1983 | Matsuura et al. | 44/1 G |
| 4,421,520 | 12/1983 | Matthews | 4/6 |
| 4,461,624 | 7/1984 | Wong | 44/6 |
| 4,495,710 | 1/1985 | Ottoson | 44/626 |
| 4,501,551 | 2/1985 | Riess et al. | 432/15 |
| 4,504,274 | 3/1985 | Anderson | 44/6 |
| 4,508,539 | 4/1985 | Nakai | 44/10 D |
| 4,511,363 | 4/1985 | Nakamura et al. | 44/1 G |
| 4,571,174 | 2/1986 | Shelton | 44/626 |
| 4,605,421 | 8/1986 | Kauffman et al. | 44/1 F |
| 4,645,513 | 2/1987 | Kubota et al. | 44/10 H |
| 4,650,495 | 3/1987 | Yan | 44/1 G |
| 4,759,772 | 7/1988 | Rogers et al. | 44/501 |
| 4,775,390 | 10/1988 | Bixel | 44/501 |
| 4,778,482 | 10/1988 | Bixel et al. | 44/501 |
| 4,783,199 | 11/1988 | Bixel et al. | 44/501 |
| 4,783,200 | 11/1988 | Bixel et al. | 44/501 |
| 4,797,136 | 1/1989 | Siddoway et al. | 44/501 |
| 4,828,575 | 5/1989 | Bellow, Jr. et al. | 44/501 |
| 4,828,576 | 5/1989 | Bixel et al. | 44/501 |
| 5,035,721 | 7/1991 | Atherton | 44/594 |
| 5,137,539 | 8/1992 | Bowling | 44/626 |

FOREIGN PATENT DOCUMENTS

| | | |
|---|---|---|
| 0 081 763 | 6/1983 | European Pat. Off. . |
| 0 325 703 | 8/1989 | European Pat. Off. . |
| 3806-584 | 9/1988 | Germany . |
| 353929 | 7/1931 | United Kingdom . |
| 636033 | 3/1947 | United Kingdom . |
| 973547 | 10/1964 | United Kingdom . |

*Primary Examiner*—Jerry D. Johnson
*Attorney, Agent, or Firm*—Leonard Bloom

[57] ABSTRACT

A process for reducing the spontaneous combustion tendencies of thermally beneficiated low rank coals employing heat, air or an oxygen containing gas followed by an optional moisture addition. Specific reaction conditions are supplied along with knowledge of equipment types that may be employed on a commercial scale to complete the process.

4 Claims, 3 Drawing Sheets

STABILIZED THERMALLY BENEFICIATED LOW RANK COAL AND METHOD OF MANUFACTURE

The Government of the United States of America has certain rights in this invention pursuant to Contract No. DE-FCC22-90PC89664 awarded by the U.S. Department of Energy.

FIELD OF THE INVENTION

The present invention is directed to the processing of coal; and more specifically preventing the spontaneous combustion of thermally beneficiated low rank coal.

BACKGROUND OF THE INVENTION

There are continuing efforts in the coal industry to develop technologies resulting in fuels derived from coal which, as compared to raw coal, burn cleaner, have higher heat (BTU) content, and are more cost-efficient to transport. In coal industry parlance, such technologies are referred to as "clean coal" technologies.

Due to the plentiful reserves of low sulfur low rank coals, one area of development related to clean coal technologies is "thermally beneficiated low rank coal." This term means coal which has been processed at elevated temperatures to generate a product with a reduced moisture content and a higher heat value per unit of weight.

Such thermally beneficiated low rank coals have shown a tendency to spontaneously combust. Although raw coal also has a tendency to spontaneously combust, this tendency in raw coal is much less pronounced than that exhibited by thermally beneficiated low rank coals. This problem impedes the commercialization of thermally beneficiated low rank coals, because it does not allow them to be stored, shipped and handled using the same techniques used with raw coal.

The present invention addresses this problem and provides a method to stabilize commercial scale quantities of thermally beneficiated low rank coals against spontaneous combustion to a degree whereby they can be handled in a manner similar to raw coal. The term stability used herein is defined as the resistance to spontaneous combustion and the term stabilization is defined as processes which produce the resistance to spontaneous combustion.

It is to be understood that the term "coal," as used herein, shall include but not be limited to, peat, lignite, sub-bituminous and bituminous ranked coals. However, the beneficiated coal primarily contemplated by this invention is thermally beneficiated sub-bituminous and lignite coal.

Coal has a tendency to spontaneously heat and combust after it is mined. This tendency is exhibited when the coal is stored in large piles; in rail cars, storage silos, storage bunkers or in like storage facilities. Spontaneous heating and combustion of coal is the result of a combination of heat released during surface oxidation and heat released by hydration, i.e. the absorption of moisture. Both the oxygen and moisture are supplied by atmospheric air. If the coal is stored in a manner in which heat from oxidation and hydration is generated faster than it can be dissipated, the temperature of the stored coal increases until the combustion temperature of the coal is reached and combustion occurs. The natural insulating qualities of the stored coal facilitates the retention of heat and its attendant spontaneous combustion. The coal industry has adapted itself to handle and use raw coal within the general constraints of the coals natural tendency to spontaneously heat and combust. One of the methods for preventing spontaneous combustion is to move or use the coal before it is allowed to sit in large storage for more than a week. For raw coals, this short storage time does not allow the temperature to the point were spontaneous combustion occurs.

The spontaneous combustion problem is exacerbated in the case of thermally beneficiated low rank coals. Some of the thermally beneficiated low rank coals have had a substantial portion of their internal water content removed; without the heat dissipation capacity supplied by the water in the parent coal, these coals have a tendency to spontaneously combust that is greater than that of raw coal. Many of the thermally beneficiated low rank coals can spontaneously combust within one or two days of being placed in a large storage pile.

To remove this barrier to the commercialization of the new thermally beneficiated low rank coals, they must be stabilized to inhibit spontaneous combustion. Ideally, they should be stabilized to the point where they have the same stability as raw coal. This will permit the new thermally beneficiated low rank coals to be used with the same handling systems and with the same handling procedures as raw coal, and will thereby greatly increase the practical value of these thermally beneficiated fuels.

The inventors recognized and faced the issue of spontaneous combustion in connection with operating a demonstration facility built to produce a thermally beneficiated low rank coal, SynCoal®. U.S. Pat. No. 4,810,258, issued Mar. 7, 1989, to Greene, describes the SynCoal® product. U.S. Pat. No. 4,725,337, issued Feb. 16, 1988, also to Greene, describes the process for making SynCoal®. This technology is referred to as the Advanced Coal Conversion Process (ACCP).

The ACCP technology was first used to produce SynCoal® in bench tests, and in a pilot plant operated in 1986, prior to the issuance of U.S. Pat. Nos. 4,725,337 and 4,810,258, described above. To further develop the ACCP technology, a 300,000 ton per year demonstration facility was constructed in 1990–92 at Western Energy Company's Rosebud Coal Mine near Colstrip, Mont. The United States Department of Energy supported the ACCP Project through its Clean Coal Technology Program. One of the ultimate objective of the Clean Coal Program is to foster the commercialization of projects that provide fuels with characteristics that allow them to replace imported, higher cost fuels, thereby reducing dependence on imported fuels.

The problem of the spontaneous combustion tendency of SynCoal®, was recognized during initial operations at the demonstration facility. Spontaneous combustion occurred within days of placing Syncoal® in air permeable storage silos or in open piles.

By repeating ACCP pilot tests in 1992, it was shown that the 1986 pilot plant produced SynCoal® which was equal in reactivity to that of the demonstration facility. The spontaneous heating characteristic was not identified at the pilot plant stage because the pilot plant generated SynCoal® in smaller quantities and at a lower rate than the demonstration facility. This low rate of production allowed enough time for the beneficiated coal to stabilize passively prior to it being covered by subsequent layers of SynCoal®.

As an initial remedy to this problem of spontaneous combustion, a technique of "pile management", i.e. periodic handling and moving of the SynCoal® stored in piles or bins was developed. Based on actual observations, SynCoal® spread at depths of less than 18 inches reached a peak temperature within approximately 2 days. High heat production was sustained for approximately 10 days, followed by a period of steady decline in pile temperatures. After being piled and held for over 3 months, spontaneous combustion did not occur, and apparently, a stable coal product was achieved. These results indicated that stability can be achieved through pile management, allowing oxidation and rehydration to occur along with sufficient heat dissipation.

By expanding on the concept of pile management, the inventors proceeded to develop a stabilization process from a bench scale to pilot scale. The inventors piloted a 1,000 pounds per hour process that produced air stabilized SynCoal® with about seven day stability. It remained a thermally beneficiated coal and retained its higher heat value per unit of weight.

The present invention stabilizes coal by using hot air or air with a reduced oxygen concentration to oxidize reactive sites on the surface of the coal. The oxidation step is followed by the addition of moisture to the coal product to bring the coal to a stable moisture level. Once the reactive sites of the coal have been oxidized and the coal adequately hydrated, the coal is stabilized and spontaneous combustion retarded. The adjustment of final product moisture content may be omitted if a lower moisture coal is desired and a less stable coal is acceptable.

The subject invention does not claim the novelty of oxidizing thermally beneficiated coals followed by rehydration. This invention teaches industrial scale methods of completing the stabilization including knowledge of maximum processing temperatures that may be utilized that minimizes the risk of process fires and the duration of processing necessary to obtain a stability level that allows handling and transporting the product using conventional means.

Fortunately, 100% stability is not required, only stability that will allow handling in a manner similar to raw coals, which allows for up to 7 days before use or rehandling. In general this 7 days before use is the time-frame meant to be comparable to raw coal used in commercial application.

Economical commercial application of oxidative stabilization requires the smallest possible reaction chamber in order to minimize construction and operating costs. If the processing can be completed in less time, the processing equipment can be scaled down resulting in reduced equipment costs and reduced operating costs.

PRIOR ART

The prior art teaches ways to thermally beneficiate and stabilize coal, but the prior art fails to teach or suggest enough information to apply the stabilization techniques on a commercial scale. Most notable is a lack of knowledge of the necessary treatment times (residence times) that will result in an adequate stability and a lack of knowledge of the optimum reactor styles for completing the oxidation step.

In addition, much of the prior art was developed on a small laboratory scale; and due to complications that are not present on a small scale, actually teach processing conditions that are unsafe on a large scale. Numerous prior patents claim treatment temperatures over 300° F., which, if applied in the presence of high (greater than 18%) concentrations of oxygen, will inevitably result in process fires.

The prior art discusses a process for thermally beneficiating coal which process is improved upon by the present invention. U.S. Pat. Nos. 4,725,337 and 4,810,258, noted above, describe the SynCoal® process and the SynCoal® product. The SynCoal® process removes a substantial portion of naturally contained water and impurities from low rank coal, while keeping much of its volatile combustible content. The resulting improved product, SynCoal®, not found in nature, has a higher BTU content per unit of weight than raw coal feedstock.

Prior art related to processes or treatments inhibiting spontaneous combustion potential of coals or char includes U.S. Pat. No. 3,723,079, issued Mar. 27, 1973 to Seitzer. The patent describes a process for stabilizing dried coal by treating it with oxygen, and then rehydrating it. The Seitzer patent: (1) teaches processing temperatures well above those in the subject patent; (2) does not supply necessary residence times; (3) does not teach knowledge of reactor type; (4) teaches different rehydration ranges; and (5) does not teach the option of omitting rehydration.

U.S. Pat. No. 4,213,752, issued Jul. 22, 1980 also to Seitzer, describes a method of inhibiting spontaneous combustion in conjunction with a drying step that supplies its own heat source by partial combustion of the coal being processed using a drying gas stream containing 5–20% oxygen. This Seitzer patent: (1) teaches processing temperatures in a range well above those in the subject patent; (2) does not teach necessary processing times; (3) does not teach rehydration ranges; and (4) utilizes a significantly different technology than the subject patent and other prior art.

U.S. Pat. No. 3,896,557, issued Jul. 29, 1975 also to Seitzer, describes a method of inhibiting spontaneous combustion in conjunction with a drying step using a drying gas stream with 7–9% oxygen. This Seitzer patent: (1) does not teach processing temperatures or times; (2) uses an much lower oxygen concentration; (3) leaves a significant amount of moisture in the coal; and (4) does not teach rehydration ranges.

U.S. Pat. No. 4,192,650, issued Mar. 11, 1980 also to Seitzer, describes a method of inhibiting spontaneous combustion utilizing steam. This Seitzer patent does not teach oxidation treatment and only rehydrates using steam.

U.S. Pat. No. 4,170,456, issued Oct. 9, 1979 to Smith, describes a method of inhibiting the spontaneous combustion of coal char by air treatment followed by carbon dioxide treatment. The Smith patent: (1) teaches processing temperatures in a range well above those in the subject patent; (2) does not supply necessary residence times; (3) does not teach knowledge of reactor type; (4) does not teach rehydration ranges; and (5) does not teach a treatment for stabilization without carbon dioxide.

U.S. Pat. No. 4,396,394, issued Aug. 2, 1983, to Li et al., describes the method of inhibiting spontaneous ignition of dried coal by cooling it, or by partially oxidizing it prior to cooling followed by the application of a deactivating fluid. The Li et al. patent: (1) does not teach any knowledge of processing temperatures or times; (2) does not teach knowledge of reactor type; (3) does not teach rehydration ranges; and (4) teaches the application of a deactivating fluid.

U.S. Pat. No. 4,645,513, issued Feb. 24, 1987, to Kubota et al., also teaches a stabilization method. The Kubota et al. patent: (1) teaches processing temperatures in a range well above those in the subject patent; (2) does not supply necessary residence times; (3) does not teach knowledge of reactor types; and (4) does not teach rehydration ranges.

U.S. Pat. No. 4,402,706, issued Sep. 6, 1983 to Wunderlich, describes a method of inhibiting the spontaneous combustion of coal with oxygen treatment in a reactor. The Wunderlich patent: (1) uses a partially dried coal and completes the drying during stabilization; (2) teaches processing temperatures in a range above those in the subject patent; (3) does not supply necessary residence times; (4) teaches a reactor type that not be effective on a full range of particle sizes and will experience process fires if operated in the claimed temperature range; and (5) does not teach rehydration ranges.

U.S. Pat. No. 3,918,929, issued Nov. 11, 1975 to Schmalfeld et al., describes a method of inhibiting the spontaneous combustion of briquetted coal by oxygen treatment in a reactor. The Schmalfeld et al. patent: (1) teaches processing temperatures in a range much higher than the subject patent; (2) does not supply necessary residence times; (3) does teach knowledge of reactor type but the subject patent teaches that the Schmalfeld et al. style of reactor will experience process fires if operated in the claimed temperature range; and (4) does not teach rehydration ranges.

There also exists a wealth of prior art dating back about 60 years that teach the application of deactivating fluids. The subject patent does not claim the need for a deactivating fluid.

SUMMARY OF THE INVENTION

The primary objective of the present invention is to provide a method for reducing the spontaneous combustion tendency of thermally beneficiated low rank coals to levels comparable to natural raw coal.

It is a further object of the present invention to provide thermally beneficiated coals with a reduced tendency for spontaneous combustion.

It is a further objective of this invention to provide optimum processing conditions that will allow economically feasible application of a stabilization process on a commercial scale.

It is a further objective of this invention to identify processing equipment and process conditions that may be economically applied to commercial quantities of coal. At least 100 tons per day of coal is a commercial quantity; and more likely commercial quantities are 1,000 to 10,000 tons per day.

One of the keys to applying oxidative stabilization is to recognize that the stabilization cannot be completed in short periods of time. The rate of oxidation can be increased by increasing the processing temperature, but care must be taken when increasing the processing temperature to avoid the condition where the coal simply ignites causing process fires.

The maximum possible processing temperature is dependent on the quality of the heat rejection inherent in the equipment used to conduct the reaction and the oxygen content in the gas used to supply oxygen to the product. Operation with a reduced oxygen gas stream allows higher processing temperatures, but the lower oxygen content increases the required residence time. Processing with a gas oxygen content approaching that of ambient air will be the most economical option. Once the maximum processing temperatures are established, the corresponding minimum residence time for a desired product stability is naturally fixed along with the necessary reactor size for any given volume of coal flow.

About 1.0–1.5% oxygen by weight will be absorbed into the coal, and for each pound of oxygen absorbed, between 2500 and 5600 BTUs will be released. In a fluidized bed reactor, the quantity of heat released is relatively manageable because of good mixing and contact; and the quantity of gas required to fluidize the bed provides a good heat dissipation. In a moving packed bed or tower style reactor with the product slowly flowing down a vertical shaft and the gas stream flowing up, the heat generated is not efficiently rejected and can act as a preheater for incoming coal. Because of the preheating effect, the maximum operating temperature in a tower type reactor is significantly lower than the maximum operating temperature for a fluidized bed reactor.

Based upon the inventors experience, in a fluidized bed reactor with optimum heat rejection and using a gas stream containing between 19 and 21% oxygen, the maximum processing temperature (coal temperature) is 250° F. A treatment time of at least 30 minutes, and preferably between 30 minutes and 60 minutes, at these conditions will be required to supply a product with an acceptable stability.

In a reactor with less efficient heat rejection such as a packed bed (tower) reactor and using a gas stream containing between 19 and 21% oxygen, the maximum average processing temperature (coal temperature) is 170° F. with a maximum peak coal temperature of 190° F. A treatment time of at least 60 minutes and preferably between 1 and 2 hours, at these conditions will be required to supply a product with an acceptable stability.

It is to be understood that the term "air," as used herein, shall include gas streams with slightly reduced oxygen concentrations. Some applications of the invention may use a fraction of the oxygen in an air stream to burn a fuel in order to heat the gas stream or may utilize a recycle stream for efficient use of heat. Either option will result in a slightly reduced oxygen concentration in the inlet gas stream. In no case would an oxygen concentration less than 17% be desirable because the resulting reduced reaction rates would increase the necessary reactor size.

It may be necessary to either screen or crush the coal to properly /size the material before it enters the oxidizing step. If a large range of sizes exist, a separate reactor may be necessary for fine and coarse coals. For example, the split may be made somewhere between 0.065 inches and 0.75 inches. For a screened coarse coal, pelletized, or briquetted coal, a tower reactor may be employed without the use of a fluid bed. Likewise, for a process that produced only a fine coal, a fluid bed may be employed without the use of a tower reactor.

The final stages of the oxidation reaction is diffusion limited. It is believed that within the product's pores, a high nitrogen concentration occurs due to oxygen depletion. The overall oxidation reaction then depends on oxygen in the air, around the product particle, diffusing into the pores. A method of combating the diffusion limited process is to alternately heat, then cool, and then reheat the product. During the alternate heating and cooling cycles, a further completion of the oxidation reaction is accomplished. The cooling stage forces fresh air to be drawn into the product pores as the interstitial gases contract. As an example, hot gas is provided for 20 minutes, followed by cold gas for 5 minutes, followed by hot gas for 17 minutes, followed by a final cool down gas for 3 minutes. A total of 45 minutes.

To obtain the most stable product, the moisture level of the treated coal must be adjusted after the oxidation reaction is completed.

Any thermally beneficiated coal will reabsorb some moisture upon exposure to air. If the heat of oxidation and heat of rehydration are rejected, the product moisture level will increase to some equilibrium state. The extent of rehydration and the length of time required to complete the rehydration is dependent on the nature of the raw coal, the type and severity of the thermal beneficiation process, the ambient temperature, and the ambient air humidity. This level of rehydration can be determined for any thermally beneficiated coal by placing a small representative portion of the product in contact with normal ambient air for a period of at least one month. The sample should be small enough that any heat of oxidation and rehydration will be rejected to the air; a sample size of about 100 lbs. would suffice. The product should be shaded from the sun to avoid radiative drying. The sample will air oxidize and rehydrate. Once an equilibrium level is reached, the coal's moisture will vary with the ambient air humidity. Preferably, a sample for the rehydrated moisture level measurement should be taken from the test coal during a period of high humidity. The resultant moisture level would be the target moisture level in the process equipment; it will likely fall between 5 and 15%.

The moisture addition may be conducted in commercially available mixers or on a slow moving conveyor belt. A minimum exposure time of 5 minutes is required to allow the moisture to be absorbed by the coal. Longer exposure times and multiple water addition points increases the ability to precisely adjust the moisture level especially when excess moisture is added to allow evaporative cooling.

When moisture is added to the coal, heat will be released and the bulk coal temperature will increase. This heat must be dissipated to obtain the most stable coal product. The coal must be cooled to the minimum possible temperature because the residual oxidation rate is dependent on the final product temperature. The most effective method of cooling is to pass ambient air through the product in a fluidized or semi fluidized state. The product's temperature will, within minutes, drop to within 15° F. of the air temperature.

The adjustment of final product moisture content may be omitted if a lower moisture coal is desired and a less stable coal is acceptable.

A method of this invention involves an improvement comprising heating and oxygenating coal. Then cooling said coal, and repeating said heating and oxygenating. This process aides in the defusing of oxygen into the pores of the coal by forcing air to be drawn into the pores of the coal, thus allowing for a more complete oxygenation.

In an alternative process after the heating oxidation, excess moisture is added beyond the target equilibrium moisture. Then an air stream is passed through the product, allowing the air and the evaporation of the excess water to remove the residual heat of the oxidation step, as well as the heat of rehydration.

In a process of this invention, unstable raw low rank coal can be subjected to a drying operation, cooled, and subjected to an oxygenation stabilizing process. The oxidized coal is then subjected to rehydration and cleaned to remove slack.

In a specific method the coal is separated a coarse coal stream and a fine coal stream. The coarse coal stream being about ¾" and the fine coal stream being 10 mesh. The coarse coal is subjected to heat oxidation treatment in a vertical tower and the fine coal is subjected to heat oxidation in a fluidized bed. The coal can be subjected to rehydration.

PREFERRED EMBODIMENTS

The following embodiments would be typical of a stabilization process step retrofitted into the ACCP demonstration facility described in the Background of the Invention set forth above.

Figure 1:
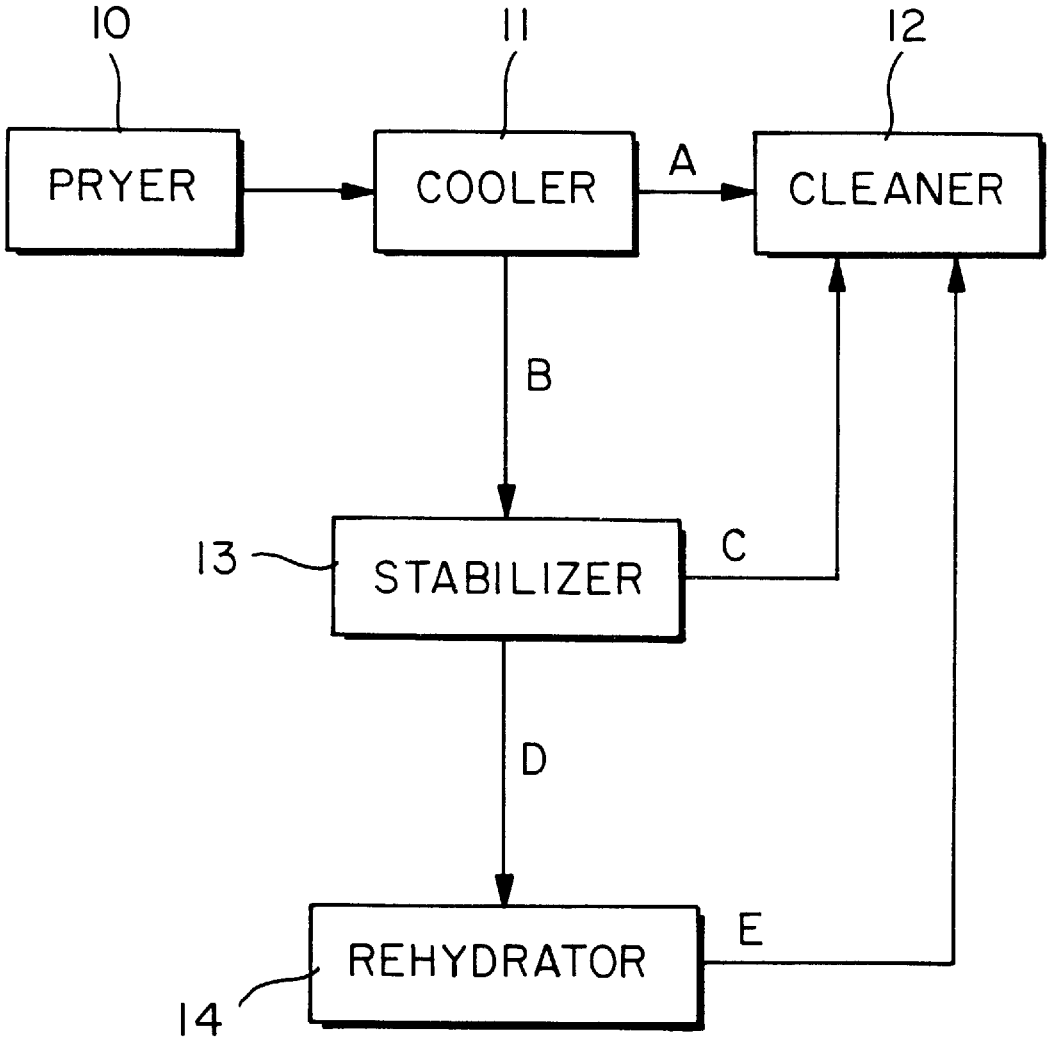
FIG. 1 is a flow chart showing the air oxidation stabilization process as incorporated into the Rosebud SynCoal® process.

FIG. 1 provides a flow chart describing the addition of the stabilization process into the SynCoal ACCP demonstration facility. In the original configuration, Syncoal drying/conversion 10 and cooling 11 equipment dries, converts, and cools the coal, and the product is then moved via path (A) to the cleaning equipment 12, prior to storage and loadout. In the improved process with the invention's stabilization process step, the product goes from the drying 10 and cooling 11 equipment to the stabilization equipment 13 via path (B). The stabilized product may be moved from the stabilization equipment 13 to the rehydration equipment 14 through alternate path (D). The alternate path would provide stabilized and rehydrated product to the SynCoal cleaning equipment by alternate path (E) prior to loadout and storage.

In the stabilization process, the coal is sized using either a screening step or a crusher. The sized coal is fed to one of two styles of reactors described below. The oxidized coal is fed to a rehydrator via path D and finally to the cleaning system via path E. Optionally, the rehydration step may be bypassed via path C if a drier but less stable product is desired.

Within the oxidation step, the coal is screened and then directed to one of two reactor designs. The fine coal is best handled in a fluid bed reactor while the coarse coal fraction is best handled in a moving packed bed or tower reactor.

Figure 2:
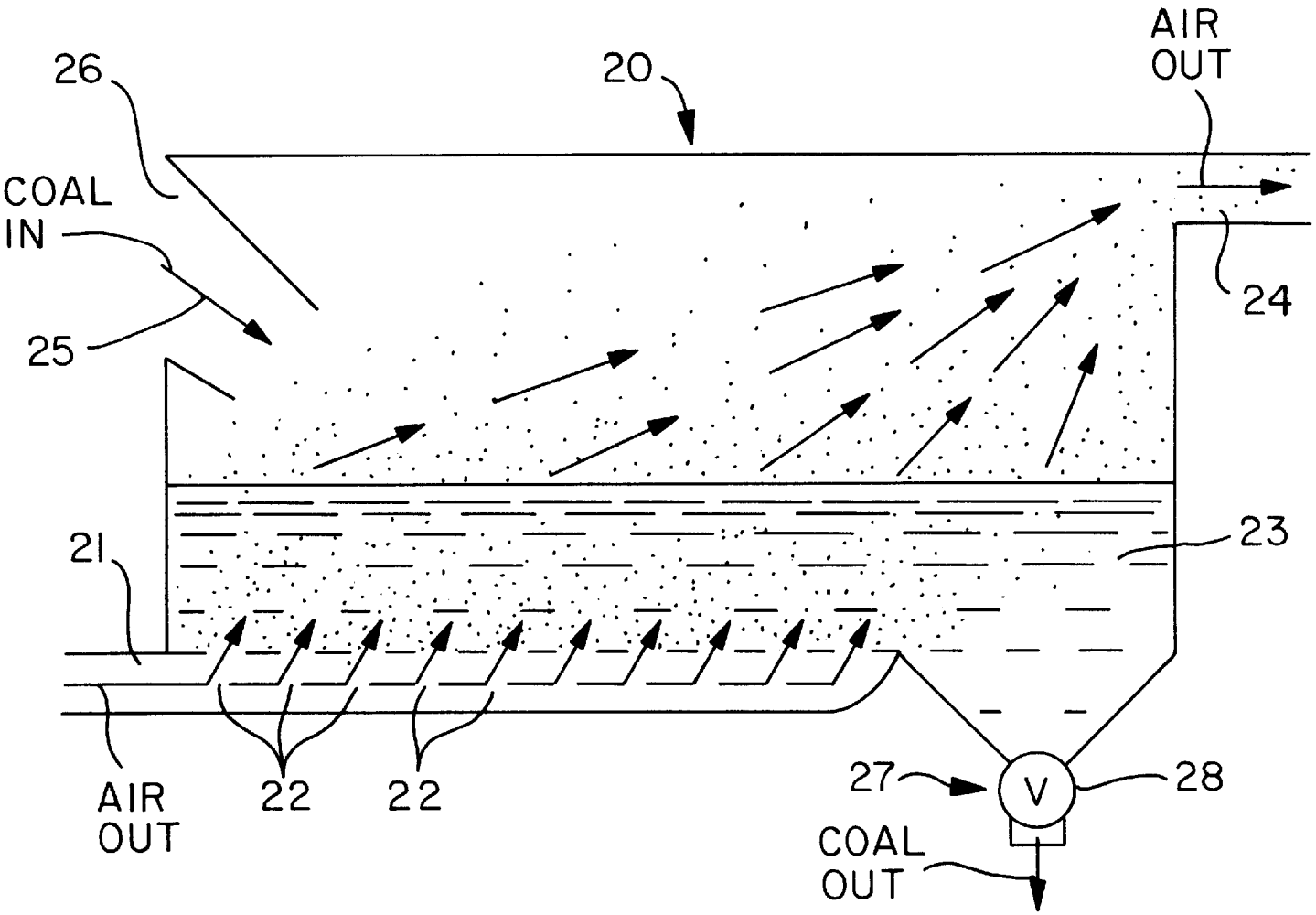
FIG. 2 shows a schematic view of the horizontal fluidized bed used in the invention to oxidize the thermally beneficiated coal.
Figure 3:
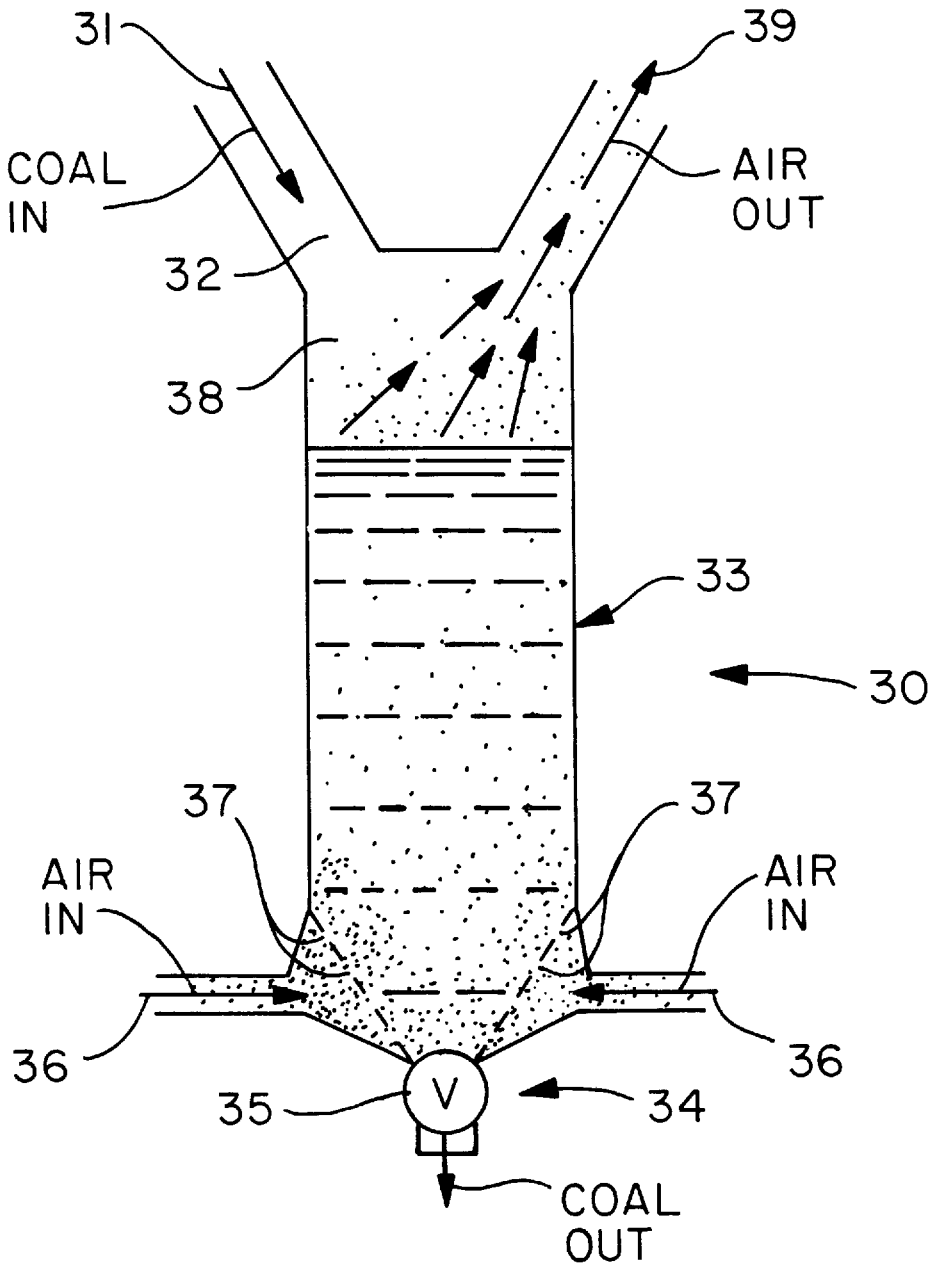
FIG. 3 is a schematic view of the vertical tower used in the invention to oxidize the thermally beneficiated low rank coal.

The fluidized bed reactor 20 (FIG. 2) works best with coal sized under 0.75 inches in diameter due to the ease of fluidizing the smaller particles. The smaller the particles, the lower the fluidization velocity and hence the lower the horsepower requirement to move the hot gas. The tower reactor 30 (FIG. 3) works most efficiently with coal sized larger than 0.065 inches (10 mesh) in diameter. Hot gas contact with the coal is inhibited unless the finest particles are excluded, because the material has a tendency to pack and prevent even gas distribution. The size at which the separation is made can be selected based on construction cost and operating efficiency.

The fluidized bed reactor 20 (FIG. 2) uses air heated at a temperature of about 200°–350° F., and oxidizes the coal at a temperature of 200°–250° F. for 30 minutes to one hour. The hot air enters the intake 21 and passes through a plurality of ports 22 to the fluidized bed 23. The heated air rises up through the bed 23 and exits through the gas discharge duct 24. The unstabilized coal enters through the inlet chute 26 and falls into the bed 23. The oxidized product exits the bed trough the valve/chute combination 27/28, when the valve 28 is opened.

The size of the processing equipment is always dependent on the flow rate of product and the required residence time. In the case of the ACCP demonstration facility, the fluidized bed used in this invention is sized to process about 38 tons/hour of fine fraction from the screening process. The fluid bed is about 47 feet long, 7 feet wide and holds a bed of coal about 4 feet deep.

In the fluidized bed reactor, the oxidation can take place in a period of 30 minutes, at the maximum possible processing temperature of 250° F. To allow a margin of error in operations so that process fires are minimized, a processing temperature of 230° F. can applied for approximately 45 minutes.

The tower reactor (FIG. 3) uses air heated at a temperature of about 140°–250° F., and oxidizes the coal at a temperature of 140– 190° F. with and average of 170° F. for one to two hours. The hot air enters the intakes 36 and passes through a plurality of ports 37 into the tower 33. The heated air rises up through the tower and disengages the coal in the freeboard section 38 then exits through the gas discharge duct 39. The coarse unstabilized coal 31 enters through the inlet chute 32 and falls into the tower 33. The oxidized product exits the tower through the valve/chute combination 34/35, when the valve 35 is opened.

The size of the processing equipment is always dependent on the flow rate of product and the required residence time. In the case of the ACCP demonstration facility, the tower used in this invention is sized to process about 38 tons/hour of coarse fraction from the screening process. The tower is about 9 feet in diameter and 60 feet high. About 10 feet of the tower height is freeboard.

In the tower reactor the oxidation can take place in a period of one hour, with a peak processing temperature of 190° F. To allow a margin of error in operations so that process fires are minimized, an average processing temperature of 150° F. with a peak coal temperature of 180° F. can applied for approximately 90 minutes.

The improved treatment method entailing alternate heating, cooling and reheating of the coal to aid in the defusing of oxygen into the pores of the coal is applied by means of alternating zones in a long fluidized bed and by recycling a fraction of the tower discharge coal.

SynCoal from the Demonstration facility has a natural rehydrated moisture level of about 7%. The rehydration step is completed on a slow moving conveyor belt.

At the Demonstration facility, excess moisture beyond the target rehydrated moisture level is added. The product is then sent to a pneumatic cleaning system where an air stream is used in semifluidized vibratory bed to remove mineral impurities. The excess moisture is evaporated and the cooling effect of the evaporation acts to remove the heat of hydration and any residual heat from the oxidation reaction.

EMPIRICAL RESULTS FROM AIR STABILIZATION TEST TRIALS

Pilot tests using two types of stabilization equipment were conducted at the SynCoal® demonstration facility.

In a horizontal fluidized bed, manufactured by Heyl & Patterson Inc., air at about 350 degrees F. was used to oxidize SynCoal® at about 230 degrees F. The volumetric percent oxygen concentration was 20%. The pilot fluidized bed processed between 400 and 1,000 pounds per hour. This was about a 1/100 scale test compared with the commercial scale. The hot air came into contact with the SynCoal® for about 45 minutes in the fluidized bed prior to cleaning.

In a vertical tower, designed and manufactured by the inventors at the ACCP Demonstration facility, 140 to 250 degrees F. air. was used to oxidize the SynCoal® at an average temperature of about 150 degrees F. The coal entered the tower at about 120 degrees F., the temperature then increased to about 180 degrees F. in the middle of the tower, and then exited the tower at about 140 degrees F. The pilot tower reactor processed between 400 and 1,000 pounds per hour which was also about 1/100 scale compared to a commercial scale.

Charts 1 and 2 show the results of test batches made with pilot scale stabilization reactors. These test results show that SynCoal® produced with the present invention has a stability of about seven days compared to a normal stability of about 1 day. The improved stability is competitive with naturally occurring low rank coal, and is adequate for the commercialization of stabilized SynCoal®.

FURTHER EMBODIMENTS

The embodiments illustrated and discussed in this specification are intended only to teach those skilled in the art the best way known to the inventor to make and use the invention. Nothing in the specification should be considered as limiting the scope of the present invention. Changes can be made by those skilled in the art to produce equivalent systems without departing from the invention. The present invention should only be limited by the following claims and their legal equivalents.

For example, the method of the invention can be used on thermally beneficiated low rank coals other than SynCoal®. Beneficiated coals and processed solid carbon fuels, and beneficiated coal in the briquetted or pelletized form other than SynCoal®, can be stabilized using the present invention process. Also, waste coals, such as culm and gob, can be beneficiated by the SynCoal® process, and stabilized by the present invention process.

Note that the present invention's process steps can be executed as part of a larger beneficiation process, or in a different sequence within the process than as indicated in FIG. 1 herein. The steps of the present invention can also be combined with other process steps, instead of being executed as separate process steps. For example, the air stabilization step may be combined with the drying step, by using some natural air in the drying step, rather than using only a completely inert atmosphere in the drying step.

Alternatively, the present invention may partially rehydrate the product before oxidation, and then rehydrate the product further after oxidation.

Obviously, many modifications may be made without departing from the basic spirit of the present invention. Accordingly, it will be appreciated by those skilled in the art that within the scope of the appended claims, the invention may be practiced other than has been specifically described herein.

We claim:

1. A method for stabilizing and preventing the spontaneous combustion of thermally beneficiated low rank coal having reactive sites comprising separating said coal into a coarse coal stream and a fine coal stream, wherein the separating takes place between 0.065 inches and 0.75 inches; and wherein the coarse coal stream is subjected to heat oxidation in a vertical tower and fine coal stream is subjected to heat oxidation in a fluidized bed, with the oxidation in the vertical tower comprising the steps of subjecting said course coal stream to heat oxidation, wherein air of 140°–250° F. enters the vertical tower at its bottom and the coal enters the vertical tower at its top and moves down the vertical tower to exit at the bottom, the temperature of coal oxidation in the center of the vertical tower being about 140°–190° F., said heat oxidation taking place for a period of 1–2 hours; and subjecting the particles of the fine coal stream to heat oxidation in a fluidized bed reactor with air heated at a temperature of about 250°–350° F., and the coal being oxidized at a temperature of 200°–250° F. for about 30 minutes to one hour, the process yielding stabilized coal with oxidized active sites and with the spontaneous combustion ability of said coal being substantially reduced.

2. The method of claim 1 wherein the coal in the course stream is about 0.75 inches and the coal in the fine stream is about 0.065 inches.

3. The method of claim 1 wherein the oxidized coal is rehydrated to a moisture level of between 5 and 15%.

4. The method of claim 1 for stabilizing and preventing the spontaneous combustion of thermally beneficiated low rank coal having pores and reactive sites, comprising after heating and oxygenating said coal, the coal is then cooled and the process of heating and oxygenating is repeated, with said alternate heating, cooling and reheating of the coal aiding in the defusing of oxygen into the pores of said coal by forcing air to be drawn into the pores of the coal, thus allowing for a more complete oxygenation of the coal.

* * * * *

UNITED STATES PATENT AND TRADEMARK OFFICE

CERTIFICATE OF CORRECTION

PATENT NO. : 5,863,304

DATED : January 26, 1999

INVENTOR(S) : VIALL et al

It is certified that error appears in the above-indentified patent and that said Letters Patent is hereby corrected as shown below:

Column 10, line 1, insert the following:

Signed and Sealed this

Thirteenth Day of March, 2001

*Attest:*

Nicholas P. Godici

NICHOLAS P. GODICI

*Attesting Officer*

*Acting Director of the United States Patent and Trademark Office*

Chart 1 Tower Style Reactor Pilot Test Results

| Test Pile Number | Reactor Residence Time | Average Processing Temperature | Duration Before Spontaneous Combustion | Stability Improvement over Baseline | Comment |
|---|---|---|---|---|---|
| 9342 Control | 0 | na | <1 day | - | Untreated |
| 9344a | 360 min | 144 F | 7 Days | 560% | |
| 9344h | 120 min | 147 F | Did not SC | At least 600% | Note |
| 9344i | 120 min | 151 F | 7 days | 470% | |
| 9344k | 120 min | 157 F | Did not SC | At least 600% | Note |
| 9344q | 90 min | 147 F | Did not SC | At least 600% | Note |

Note: Well stabilized-small test piles sometimes did not spontaneously combust; instead they would become permanently stabilized. This was not an indication of completely stabilized coal; rather it indicated very good stability in combination with a small test pile. Larger test piles would have combusted.

Chart 2
Fluid Bed Style Reactor Pilot Test Results

| Test Pile Number | Reactor Residence Time | Average Processing Temperature | Duration Before Spontaneous Combustion | Stability Improvement over Baseline | Comment |
|---|---|---|---|---|---|
| 9342 s | 30 min | 240 F | Did not SC | At least 600% | Note |
| 9342 aa | 45 min | 220 F | Did not SC | At least 600% | Note |
| 9342 ad | 45 min | 220 F | Did not SC | At least 600% | Note |
| 9344 ae | 70 min | 240 F | Did not SC | At least 600% | Note |

Note: Well stabilized-small test piles sometimes did not spontaneously combust; instead they would become permanently stabilized. This was not an indication of completely stabilized coal; rather it indicated very good stability in combination with a small test pile. Larger test piles would have combusted.